United States Patent [19]

Shaffer et al.

[11] Patent Number: 4,915,005

[45] Date of Patent: Apr. 10, 1990

[54] FINGERING DISPLAY FOR MUSICAL INSTRUMENT

[76] Inventors: John R. Shaffer, 4691 Albany Cir. #136, San Jose, Calif. 95129; Robert W. Gorry, Jr., 17 Pendleton St., New Haven, Conn. 06511

[21] Appl. No.: 236,509

[22] Filed: Aug. 25, 1988

[51] Int. Cl.[4] ..... G10D 3/06; A63J 17/00

[52] U.S. Cl. ..... 84/314 R; 84/464 A; 84/485 R

[58] Field of Search ..... 84/464 R, 464 A, 314 R, 84/478, 485 R

[56] References Cited

U.S. PATENT DOCUMENTS

| | | | |
|---|---|---|---|
| 3,881,390 | 5/1975 | Gullickson | 84/478 |
| 3,978,757 | 9/1976 | Johnson, Jr. et al. | 84/485 R |
| 4,061,072 | 12/1977 | del Castillo | 84/478 |
| 4,080,867 | 3/1978 | Ratanangsu | 84/478 |
| 4,295,406 | 10/1981 | Smith | 84/478 |
| 4,314,499 | 2/1982 | Olsen | 84/478 |
| 4,378,720 | 4/1983 | Nakada et al. | 84/478 |
| 4,694,723 | 9/1987 | Shinohara et al. | 84/478 |
| 4,763,558 | 8/1988 | Johnson, Jr. | 84/485 R |

*Primary Examiner*—Michael L. Gellner
*Assistant Examiner*—David M. Gray
*Attorney, Agent, or Firm*—Charles M. Carman, Jr.

[57] ABSTRACT

For a musical instrument, a fingering display apparatus that includes a number of electrical switches manually operable to designate a desired musical note, either alone or as the root note for a desired scale or chord. For each of the notes designated by the switches, means are provided to activate a sub-display showing all of the possible fingering positions for that note. If a scale or chord is designated, then all of the fingering positions for all of the notes of the entire scale or chord are displayed. One form of the display, using small electrical lamps, is mounted on the fret-board of a guitar.

19 Claims, 5 Drawing Sheets

117
112

117
112

15
15
101
151
152
118a
119a
122a
121a 159
153
154
156
157
161
E
A
D
G
B
E
102
158
152
111
117

112
117

112
117

112

FINGERING DISPLAY FOR MUSICAL INSTRUMENT

This invention relates to musical instruments requiring fingering operations, and particularly to displays showing where the fingers are placed for the production of musical notes or predetermined combinations of notes.

BACKGROUND OF THE INVENTION

Previously in the piano and organ arts, keyboards have been produced in which each key position has a miniature electric lamp to be energized in automatic timed display showing the successive finger positions for picking out little one-fingered tunes. Chords and other groups of notes meant to be Played simultaneously are not dealt with. Issued patents in this field include U.S. Pat. No. 4,694,723. A single-note pick-out lamp display is also provided for simulated or actual guitar fingerboards in U.S. Pat. No. 4,080,867, and for chords in U.S. Pat. No. 4,295,406, U.S. Pat. No. 3,881,390, U.S. Pat. No. 4,378,720 and U.S. Pat. No. 3,978,757. In the chord-displaying inventions, only one set of two to six simultaneous finger positions can be shown at one time. However, the standard set of keys for the piano includes notes from eight octaves, so at least seven sets of simultaneous fingering positions for a chord are possible, one set in each octave. The guitar usually has only two octaves, or three at most, but permits a choice of many different fingering combinations in each octave for each chord. For the beginning guitar student, and for the piano student as well, there exists a need for displaying at one time all of the different fingering combinations that may be possible for a certain chord, so as to define the range of choice. A similar need exists for concurrently displaying all of the positions from which a given note may be played, or all of the notes of a scale.

OBJECTS OF THE INVENTION

Accordingly, it is an object of the present invention to provide a musical note fingering display for a manually operable musical instrument.

It is another object of the invention to provide a fingering display as above described and functioning to display concurrently all of the possible fingering positions for a note, a scale or a combination of notes to be played simultaneously.

SUMMARY OF THE INVENTION

The above and other objects are attained by the structure of the invention, which includes a number of electrical switches manually operable to designate a desired musical note, either alone or as the root note for a desired scale or chord. For each of the notes designated by the switches, means are provided to activate a sub-display showing all of the possible fingering positions for that note. If a scale or chord is designated, then all of the fingering positions for all of the notes of the entire scale or chord are displayed. One form of the display, using small electrical lamps, is mounted on the fretboard of a guitar.

THE DRAWING

DETAILED DESCRIPTION OF THE INVENTION

Figure 1:
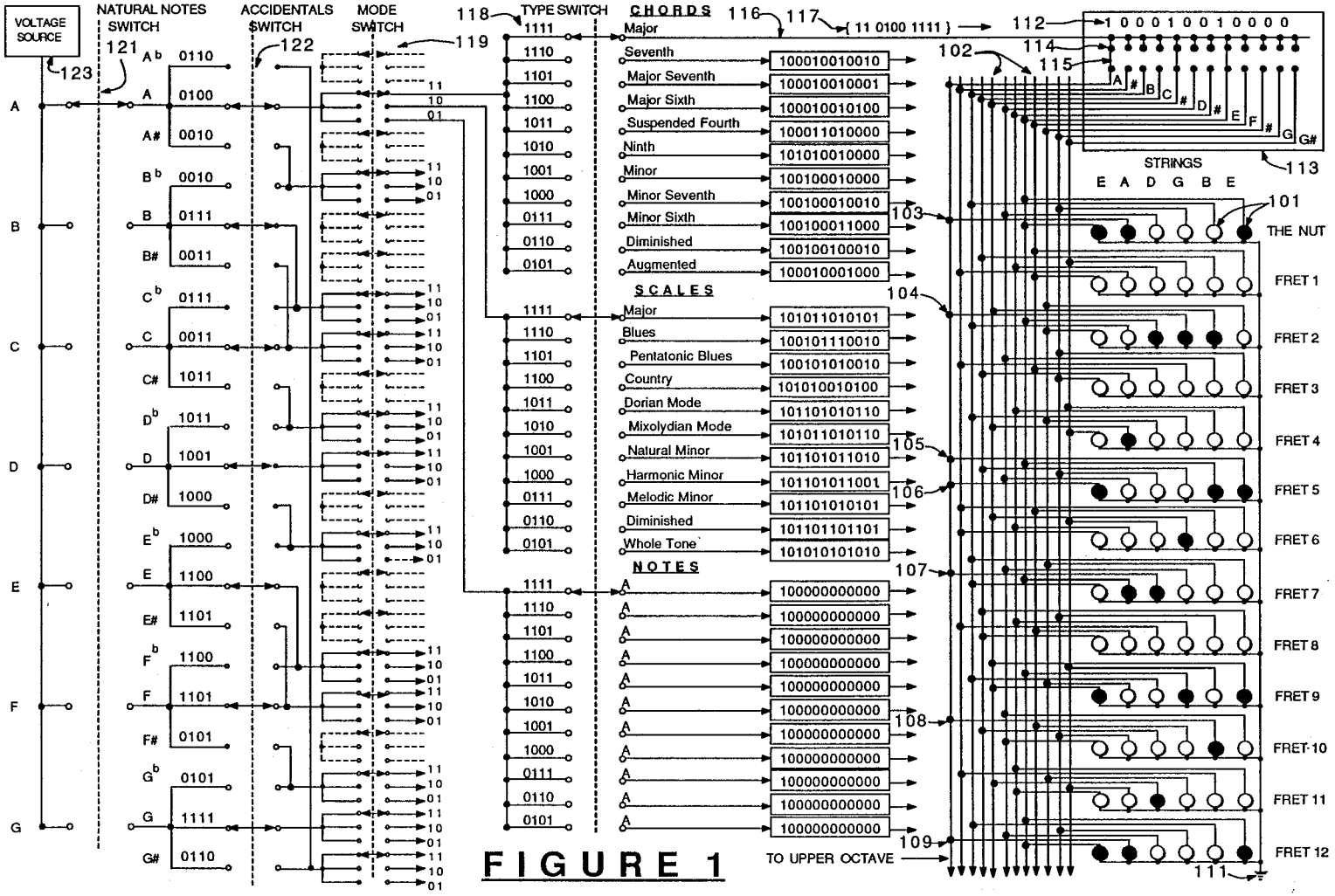
FIG. 1 is a schematic diagram illustrating a four-switch arrangement for designating each of twelve musical notes and a selection of eleven scales or chords rooted on each note, together with a note display for the fret-board of a six-string guitar.
Figures 2, 3, 4, 5:
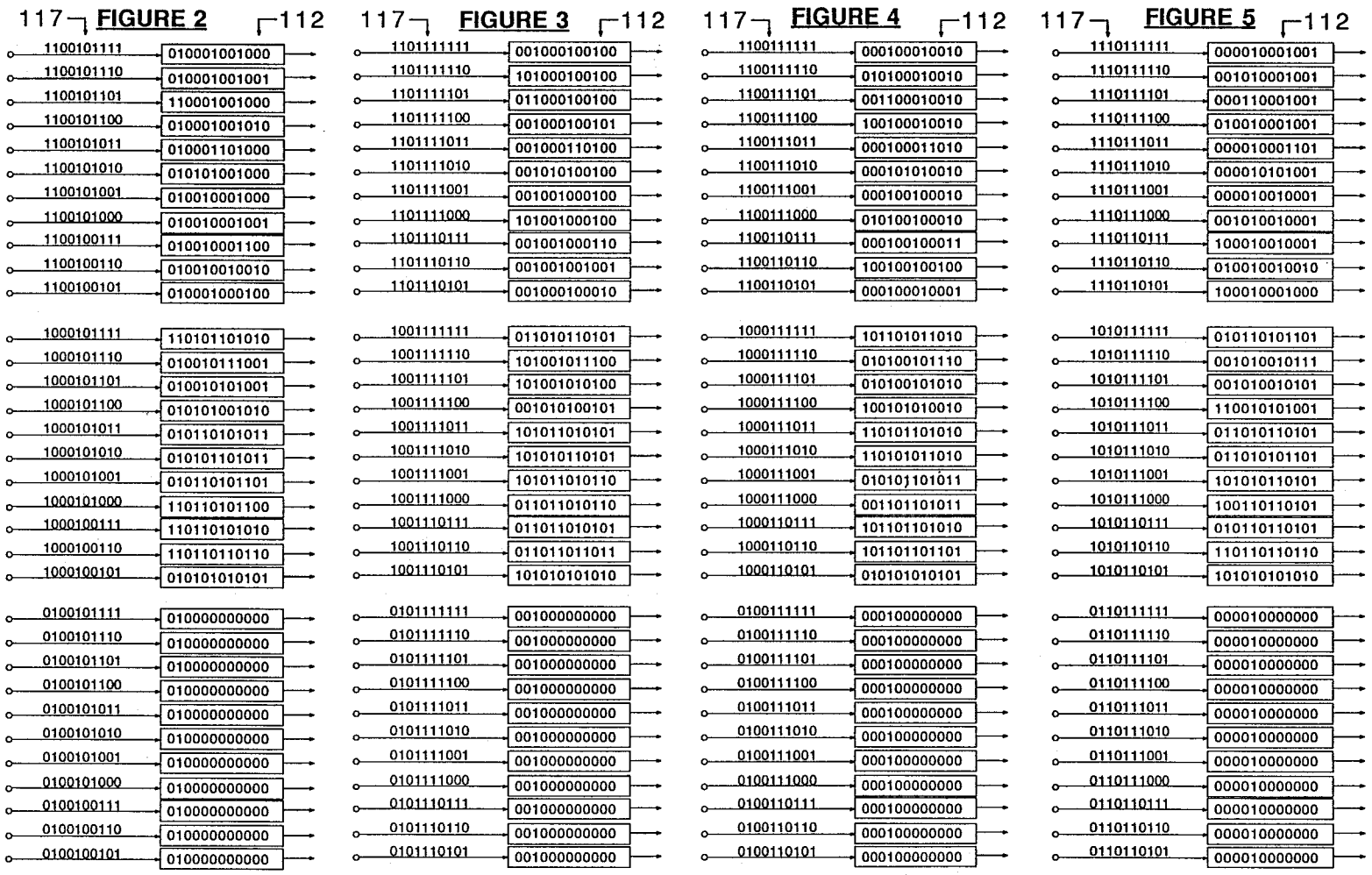
FIG. 2 is a schematic diagram continuing a portion of the arrangement shown in FIG. 1.
FIG. 3 is a schematic diagram continuing a portion of the arrangement shown in FIG. 1.
FIG. 4 is a schematic diagram continuing a portion of the arrangement shown in FIG. 1.
FIG. 5 is a schematic diagram continuing a portion of the arrangement shown in FIG. 1.
Figures 6, 7, 8, 9:
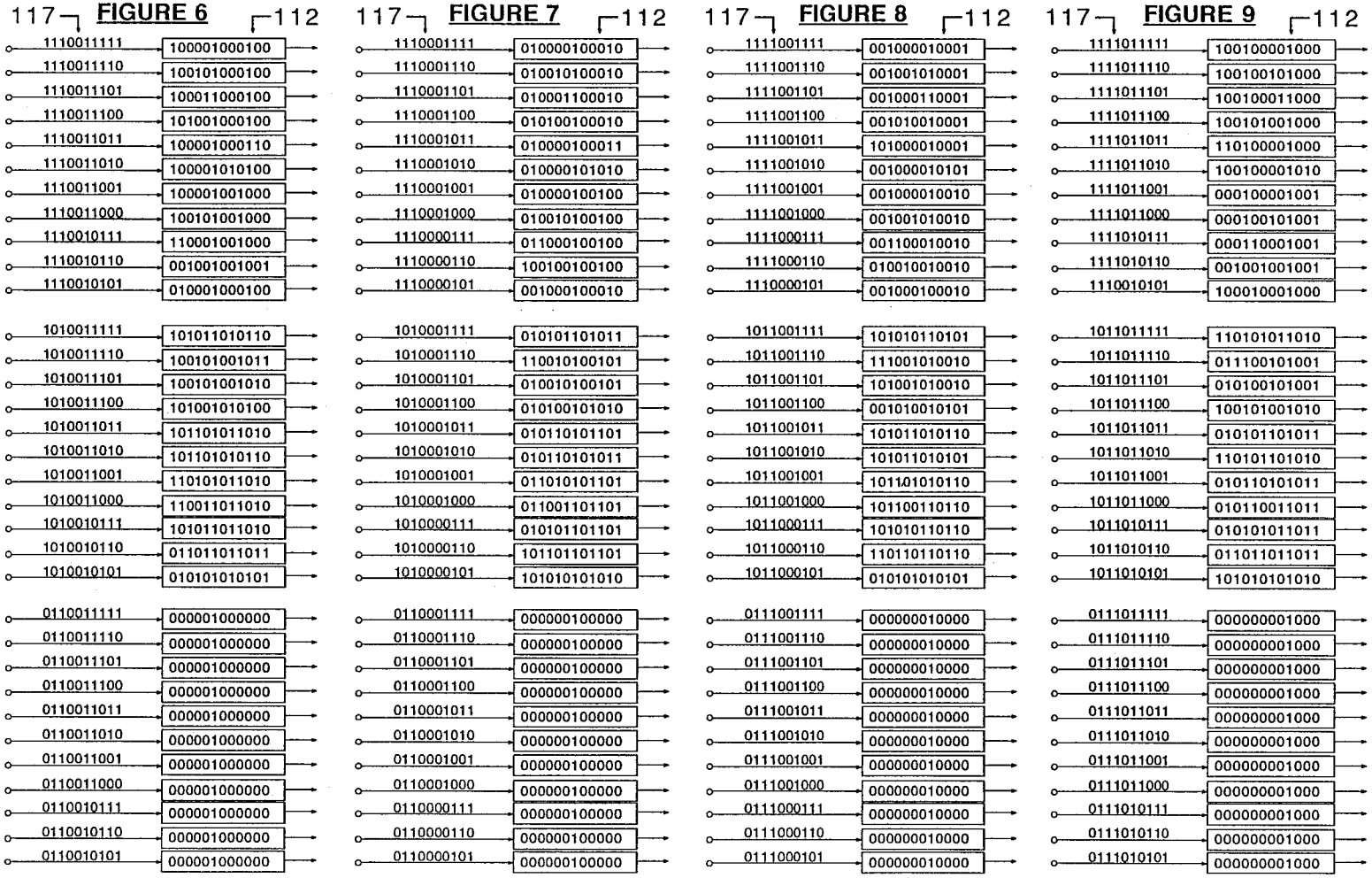
FIG. 6 is a schematic diagram continuing a portion of the arrangement shown in FIG. 1.
FIG. 7 is a schematic diagram continuing a portion of the arrangement shown in FIG. 1.
FIG. 8 is a schematic diagram continuing a portion of the arrangement shown in FIG. 1.
FIG. 9 is a schematic diagram continuing a portion of the arrangement shown in FIG. 1.

FIG. 1 shows an array of electrically energized indicators 101 for the fretboard or fingerboard of a six-string guitar. The indicators 101 may be small electric lamps, or light-emitting diodes (LED's), or liquid-crystal display modules (LCD's) or any other type of indicator system adapted to change its visible appearance in response to electrical energization. The left-hand column of thirteen indicators 101 is aligned in positions below, and slightly offset to the right, from the left-most string (the lower E-string) of the guitar, so that a right-handed musician will perceive the indicators in the same line-of-sight with the string to which they pertain. For a left-handed guitar, the offset would be to the left of the string. For clarity of illustration, the strings are not shown in this FIG., but for those unfamiliar with guitar construction, some details are provided in the discussion of FIGS. 14 and 15 below.

Figure 13:
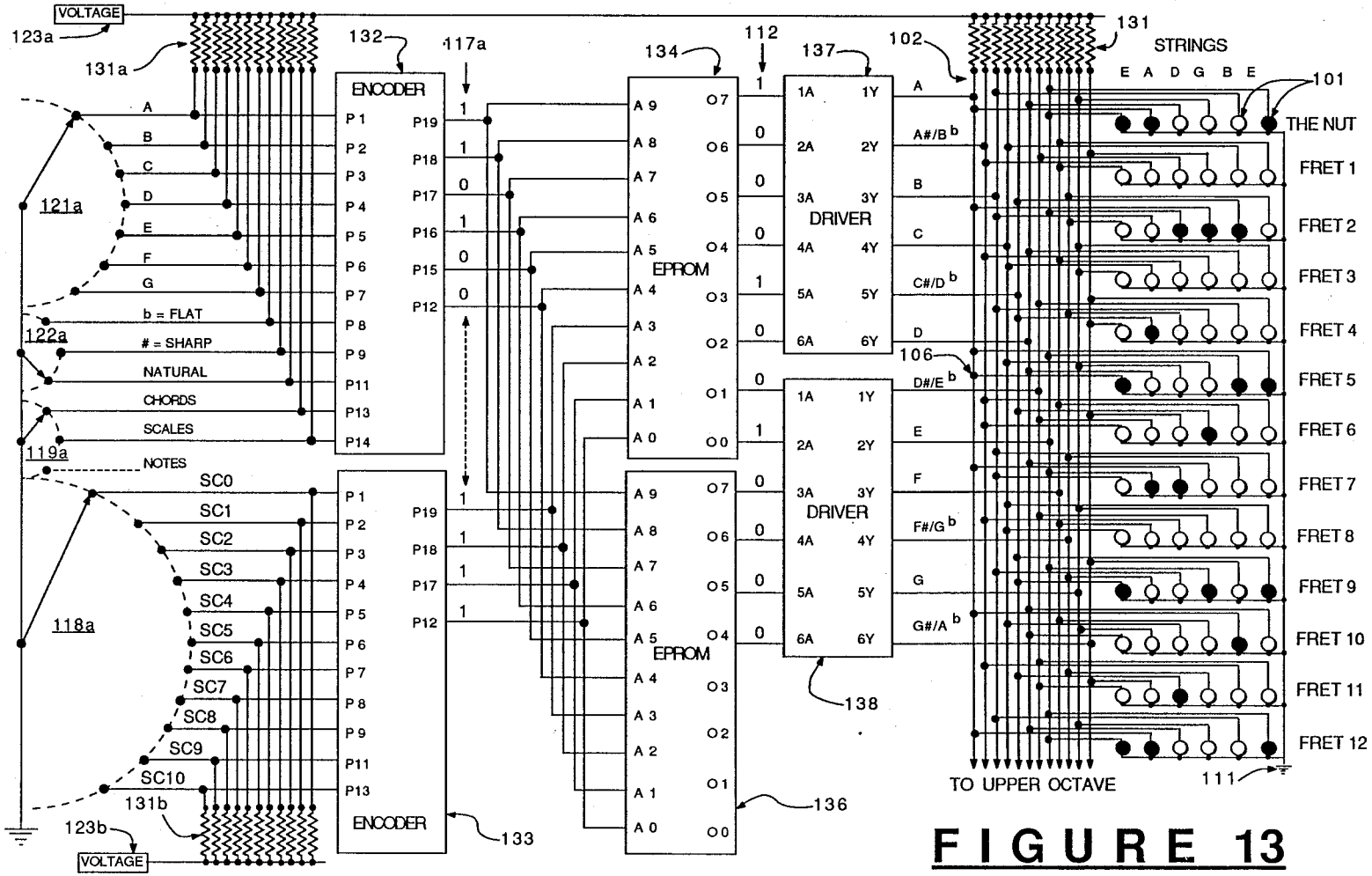
FIG. 13 is a schematic diagram illustrating the invention of FIG. 1 constructed with microchip logic devices for mounting on an actual guitar.

In FIG. 1 the general lateral Positions of the six strings are indicated at the top of the array of indicators 101, as by the string-names from left to right: the sixth string or lower-E-string; the fifth string or A-string; the fourth or D-string; the third or G-string; the second or B-string; and the first or upper-E-string, which is tuned two octaves higher than the sixth or lower-E-string. Thus there are six indicators 101 in each horizontal row or fret position. The frets are raised ridges at which the strings may be pressed by the musician's fingers against the fingerboard to shorten the freely vibrating length of string, thus raising the Pitch of the audible tone or note that is produced when the string is stroked or plucked. The frets are spaced to raise the pitch one-half tone or one note from one fret to the next, and there are from nineteen frets (flamenco) to twenty-four frets (Django Reinhardt), or even thirty-six, on the various styles of instrument. Twenty-three frets allow for twenty-four notes, including that of the open (unfingered) string, or two full octaves of twelve notes each. The most outboard octave, toward the free end of the guitar neck, is a complete one, and any shortfall in the number of notes (less than twenty-three) in the particular style or make of guitar is allotted to the inboard or upper octave. Because the total number of notes varies from style to style and make to make of instrument, and because the fingering positions are identical for the same note in either octave, it is customary in instruction manuals to illustrate only the frets 1 to 12, representing only the lower or outboard octave, plus "the nut", a fret-like but higher ridge over which the strings are bent to the outboard anchoring and tensioning means. Thus the drawing in FIGS. 1 and 13 shows indicators 101 for the nut and the first twelve frets, it being understood that there are as many more indicators 101 as are needed to complete that portion of the upper octave that is provided for on the style of guitar to which the invention is being applied; also that additional sets of indicators may be provided for additional strings, or fewer for fewer.

It will be noted that some of the indicators 101 are shown as circular objects with white interiors, and some as circular objects with black interiors. The black indicators represent the energized set for a chord, in this case the chord of A-major comprising the notes A, E and C-sharp (the symbol # is used for sharp and the letter b for flat throughout the drawing). The energization for each of the three notes is provided through a particular one of twelve power conductors 102. Thus the left-most conductor 102 energizes all of the indicators for producing an A-note, as by connections at the points 103, 104, 105, 106, 107, 108 and 109. Of course, the connection at point 103 is to prescribe an open A-string (unfingered). The electrical connection for each of these A-note position indicators runs from the left-most power conductor 102, through the indicator and to a ground connection 111 shown just below fret 12.

The power conductors 102 are selectively energized by a memory output signal 112 that is stored in a pre-set memory register 113, containing an array of twelve link-holders 114, one for each of the twelve notes. Each link-holder 114 is connected in parallel to an input power line 116 and to different one of the power conductors 102, but the links held by the link-holders 114 have all been incapacitated or destroyed, except for the three links 115 shown, which remain to activate the A-note indicators, the E-note indicators, and the C-sharp indicators comprising the chord of A-major. The connections preserved in the memory register 113 may be symbolized by means of the twelve-digit binary number 112 (the signal) shown above the link holders 114. All the broken links are symbolized by the binary "0" (zero), and the unbroken links by the binary "1", the positions being as shown: the "1" in the first digit-position represents the unbroken link 115 in the first link-position, for the A-note; the "1" in the fifth digit-position represents the unbroken link in the fifth link-position, for the C-sharp; and the "1" in the eighth digit-position represents the unbroken link in the eighth link-position, for the E-note. This twelve-digit binary number 112 thus represents the contents of the memory register, as well as the output of the register when it is activated as by electrical signal from the input power line 116, and this number 112 becomes a convenience for designating the particular connections to be made for each of the 395 other registers shown in FIGS. 1–12, without the need for showing the internal link-connections peculiar to each.

Each of the 396 memory registers may be referred to by a particular name, designation or address in the form of a ten-digit binary number 117, of which the last four digits ("1111" in the case of the A-major chord) refer to one of the positions of an eleven-position manually operable type-switch 118, while the first two digits ("11" in the case of the A-major chord) refer to one of the positions of a three-position manually-operable mode-switch 119; and the middle four digits ("0100" in the case of the A-major chord) refer to the combined positions of a manually-operable seven-position natural root-note switch 121 and a three-position accidentals root-note switch 122, all connecting a voltage source 123 to ground 111 through the appropriate memory register and indicators 101.

It will be understood that production or transmission of the ten-digit binary address 117 is not essential for operation of the memory registers illustrated in FIG. 1, because the connections for energizing the appropriate register and indicators 101 are all automatically made when the switches 118, 119, 122 and 121 are operated, whether one knows the address 117 or not. However, this address 117 is useful for understanding and explaining the illustrated apparatus, and is also particularly appropriate for drawing an analogy between the FIG. 1 apparatus and that of FIG. 13. The apparatus of FIG. 13 is substantially the same circuit put together with space-saving micro-chips, which do in fact require the production and transmission of the address 117 (or its equivalent 117*a*) for the operation of each memory register.

Returning now to FIG. 1, under the operation of the type-switch 118, the last four of the address digits 117 may be selected as shown for chords as follows: "1111" for the major chord, "1110" for the seventh, "1101" for the major seventh, "1100" for the major sixth, "1011" for the suspended fourth, "1010" for the ninth, "1001" for the minor, "1000" for the minor seventh, "0111" for the minor sixth, "0110" for the diminished, and "0101" for the augmented.

For scales, the selection is: "1111" for the major, "1110" for blues, "1101" for pentatonic blues, "1100" for country mode, "1011" for the dorian mode, "1010" for the mixolydian mode, "1001" for the natural minor, "1000" for the harmonic minor, "0111" for the melodic minor, "0110" for the diminished and "0101" for the whole tone.

It will be understood that there are many more chords and scales in the lexicon of music than are shown here, these having been chosen as basic didactic sets. With additional hardware and circuit connections, any or all of the possible chords, scales or other note combinations and arrays may be incorporated into the structure of the invention.

The same note is produced by all of the Positions of type-switch 118, which would be redundant in the apparatus of FIG. 1, but is illustrated therein to complete the analogy with the apparatus of FIG. 13, in which it is easier to make the redundant connections than to avoid doing so. This seeming contradiction is explained by reference to the upper right-hand corner A-major chord memory register 113 (address 117=1101001111). If the registers 113 are purchased as standard manufactured commercial items, with all twelve links in place, then the adapting of one register to represent the A-major chord would clearly be less time-consuming if the three links designated by the binary "1", representing the A-note, the E-note and the C-sharp, could be *broken,* instead of being left intact, while the other nine are broken. Such an end can be, and is, achieved with the circuit shown in FIG. 13. The eleven redundant registers that may be reached by the switch 118 through the switch 119 in the "01" or "note" position, for the A-note, as shown in FIG. 1, are each provided with the stored output binary number 100000000000, in which the binary digit "1" represents in FIG. 1 a link that is broken, but in in FIG. 13 represents the only link that is not broken. The electrical circuit making this end possible will be further explained in connection with FIG. 13.

Returning now to FIG. 1, the mode switch 119 selects among chords ("11"), scales ("10") and notes ("01"); and the accidentals switch 122 selects among sharp, flat and natural variations of the root-note; while the natural notes switch 121 selects only the natural portion of the root-note. While a simple twelve-position switch would operate just as successfully for selecting any of the twelve possible root-notes, it appears to be useful for music-student teaching purposes to divide the selection between the two switches, 121 for the natural Portion of the note, and 122 for the accidented. Accordingly, nine of the twenty-one groups of contacts appearing in the mode switch 119 are shown in dashed lines, unconnected and unused, while a corresponding nine of the twenty-one contacts of switch 122 are shown as cross connected to various of the twelve remaining contacts. For example, the contact for A-flat is cross-connected to the contact for G-sharp, and both are given the same four digits "0110" to form the middle part of the memory address. No matter which accident is selected by the student, he will get the same result. Likewise, A-sharp is cross-connected to B-flat and both are designated "0010". B-sharp is cross-connected to give a "C" (0011) if the student selects either combination; while the C-flat is cross-connected to give a valid "B" (0111); C-sharp and D-flat are cross-connected to give the accidental (1011); D-sharp and E-flat (1000); E-sharp to give an "F" (1101); F-flat to give an "E" (1100); and F-sharp and G-flat for the accidental (0101). The natural notes giving unique address contributions are: "A", 0100; "D", 1001; and "G", 1111.

Referring now to FIGS. 2–12, the remainder of the total array of registers with contents (outputs) of 12-digit binary numbers 112 representing the connections made to power conductors 102, together with the register addresses 117, are shown, and should be understandable without further explanation. To confirm by one randomly chosen example, however, the twentieth register from the top in FIG. 11, having the address 1011110111, is selected by setting the switch 119 at the middle position "10" (the first two digits of the address) for scales; and the switches 121 and 122 a G-natural "1111" (the third through sixth digits of the address); while the last four digits "0111" of the address designate the setting of switch 118 for the melodic minor scale (beginning at the root-note "G").

Turning now to FIG. 13, it will be seen that the same array of indicators 101 are coupled through an array of pull-up resistors 131 to a voltage source 123*a*, established at +5 volts, for example, and also to ground 111. Therefore, unless inhibited, all of the indicators would be energized. The action of the remainder of the circuit establishes selective inhibition of all but the desired indicators; i.e., for the A-ma]or chord, the indicators 101 with white interiors are inhibited from being energized, and the black-centered indicators 101 are permitted to be energized.

It is to be understood of course, that in both FIGS. 1–12 and FIG. 13, an on-off switch, not shown, may be provided for inactivating the entire system when it is not in use.

To provide the above-mentioned selective inhibition action, a set of commercially available logic microchips 132, 133, 134, 136, 137 and 138 are provided and are programmed as by means well-known in the art and further described below. The manually-operable switches are shown in this Figure to be rotary switches 121*a,* 122*a,* 119*a* and 118*a.* Push-button switches may also be used, but are not illustrated here.

The output contacts of the switches 118*a*–122*a* are all connected to the same or a similar source of voltage 123*a* as the indicators 101, and similarly through similar arrays 131*a* and 131*b* of pull-up resistors, so as to be always energized except when and where the pivot portions of the rotary switch-arms for the switches 118*a*–121*a,* respectively, couple the switch contacts to a common ground, as shown. The values for resistors 131 are established, for example, at 150 ohms each, and the values for resistors 131*a* and 131*b* at 1000 ohms each.

Thus it will be seen that the signals for the unselected notes of switch 121*a* (B through G) are all positive 5-volt signals to ports P2, P3, P4, P5, P6 and P7 of the chip 132, which is a mode and note encoder. Only the contact for the A-note selected by the switch 121*a* does not Provide a positive-voltage signal, for it connects the source 123*a* directly to ground, and the voltage becomes zero at the port P1 of encoder 132, for the A-note. In terms of Boolean logic, this arrangement is expressed by saying that the system sends a "not-A" signal to port Pl. Such a "not-A" signal is written as an "A" with a horizontal bar above it, and is also conventionally typographed as an "A" preceded by a slash-mark, i.e.: "/A" and this symbol serves to positively identify the A-note as the note that has been selected by the switch 121*a.*

Likewise, the switch arm for the rotary accidentals switch 122*a* is set to select the "natural" A-note rather than the A-flat or A-sharp, and thus a "not-natural" signal, for which the Boolean expression is "/nat", is sent to the port P11 of encoder 132, while Ports P8 and P9 recieve a positive 5-volt signal indicative of no selection. The encoder 132 is programmed, as described below, to receive the "not-A" and the "not-natural" signal and to produce an output address signal containing as the third, fourth, fifth and sixth binary digits the expression "0100". These digits emerge as a "/R3" signal expressed as a binary "0" (zero) at port P17 of encoder 132; , an "R2" signal, expressed as a binary "1" at port P16; and "/R1" and "/R0" signals, both binary zeros, at ports P15 and P12, respectively.

The logic equations for programming the encoder 132 to produce these results are as follows, the term "#" meaning "sharp", "b" meaning "flat", the symbol "+" meaning the logical "or", and the symbol "*" meaning the logical "and":

$$/R3=/A+/B+/C^*/b+/C^*/nat+/F^*/\#+/G^*/b+/G^*/\# \quad (1)$$

$$/R2=/D+/A^*/\#+/E^*/b+/B^*/b+/B^*/\#+/C^*/nat+/C^*/\# \quad (2)$$

/R1=/E+/F+/G*/b+/A*/nat+/D*-/nat+/D*/# (3)

/R0=/A+/B*/b+/D*/#+/E*/b+/E*/-nat+/F*/b+/G*/# (4)

It will be seen that the "/A" signal produced by switch 121a satisfies the corresponding "/A" term in equations (1) and (4), dictating the binary zero outputs of ports P17 and P12, while the concurrent existence of the "/A" and the "/nat" signals produced by switches 121a and 122a satisfies the "/A*/nat" term of equation (3), dictating the binary zero output at port P15. No combination of inputs to the decoder 132 satisfies any of the terms of equation (2); consequently the output at port P16 must be the binary "1" Thus the expression "0100" (reading from left to right) produced for the third to sixth digits of the encoder output address 117a may be inferred by scanning with the eye from top to bottom of the four outputs from ports P17, P16, P15 and P12.

Meanwhile, at the rotary three-position mode switch 119a, the switch arm of which is set for "chords", a "not-chord" signal "/chord" has been produced and applied to the encoder 132 through input port P13. Concurrently, a positive-voltage "scale" signal is applied to input port P14. The encoder 132 is programmed in accordance with the following logic equations to produce an output at ports P19 and P18 to supply the first two binary digits of the encoder's output address 117a:

/M1=/scale*chord (5)

/M0=chord*scale (6)

It will be seen that, with the switch 119a set at "chords", the resulting "/chords" signal applied to port P13 satisfies neither of the equations (5) or (6), and the output from ports P19 and P18 must be the binary expression "11". The full first seven digits of the encoder output address 117a now may be inferred by scanning from top to bottom of the array P19, P18, P17, P16, P15, P12. This portion reads from left to right: "110100". If the switch 119a had been set to "scales", then port P13 would have a positive-voltage "chord" input concurrently with a "/scale" input at port P14, satisfying equation (5) but not equation (6); therefore the output would be a binary "1" at port P19 and a "zero" at P18. If the switch 119a were set to "notes", then both P13 and P14 would have positive-voltage "chord" and "scale" inputs, respectively, and equation (6) would be satisfied but not equation (5); therefore the output at ports P19 and P18 would be "zero" and "1", respectively. Thus no connection between the "notes" contact on switch 119a and encoder 132 is needed.

Turning now to the type encoder 133, which is identical to encoder 132, but is programmed differently, it will be seen that type switch 118a has a rotary switch arm that may be set at any of eleven output contacts SC0, SC1, SC2, SC3, SC4, SC5, SC6, SC7, SC8, SC9 or SC10, corresponding to the eleven types of chords, scales or notes shown in FIG. 1 under the type switch 118 heading. Assisted by a voltage source 123b and an array of eleven pull-up resistors 131b, this rotary type switch 118a delivers positive voltage signals to all of the eleven input ports pl through P9 and P11 and P13 of encoder 133, except of course, the single contact at which the switch 118a is set, in this case the contact SC0 for port P1, which receives a "/SC0" signal. The encoder 133 is programmed to receive these input signals and to produce a four-digit portion of the encoder output address 117a at output ports P19, P18, P17 and P12, respectively, of encoder 133. The logic equations for the four ports respectively are:

/T3=/SC8+/SC9+/SC10 (7)

/T2=/SC7+/SC6+/SC5+/SC4 (8)

/T1=/SC10+/SC7+/SC6+/SC3+/SC2 (9)

/T0=/SC9+/SC7+/SC5+/SC3+/SC1 (10)

It will be seen that, with the switch 118a set at SC0 for "major" (chords), none of the equations (7)-(10) are satisfied, and the output at ports P19, P18, P17 and P12 of encoder 133 must be the binary "1111". It now is possible to infer the entire ten-digit address 117a output from the encoders by scanning the outputs of both encoders from top down, as arranged in FIG. 13; the address is "1101001111" for the selection of the A-major chord, and a representation of the address is designated in FIG. 13 by the reference numeral 117a.

It will be noted that this address 117a is identical with the address 117 associated in FIG. 1 with the register 113 for the A-major chord. Thus the traverse of analogy is closed, at this stage, between the structures of FIGS. 1 and 13.

It should be mentioned at this point that the encoders 132 and 133 used in the actual construction of the invention were manufactured by Advanced Micro Devices, Inc., 901 Thompson Place, P.O. Box 3453, Sunnyvale, Calif. 94088, and are model PAL16L8 described in *The PAL Device Data Book* published in 1988 by that company. The expression "PAL" is a registered trademark owned by that company. As described therein, the device uses fusible-link programming technology (referred to above in the description of memory registers 113 of FIGS. 1-12), together with logic functions such as those described in equations (1)-(10) above. It is an industry standard that each encoder device has its own voltage supply and ground connection, not shown in FIG. 13. For example, the two encoders 132 and 133 may be coupled in parallel between voltage source 123a and ground 111, using ports specified by the manufacturer for this purpose. Other companies make similar devices, and their structures and programming procedures are well-known in the art. The logic equations (1)-(10) given above should therefore constitute a definitive specification for those skilled in the art, enabling faithful replication of the functions of encoders 132 and 133, without further descriptive detail.

The address 117a from encoders 132 and 133 is transmitted to a pair of EPROMS 134 and 136. The term "EPROM" is an acronym for "erasible programmable read-only memory". The particular devices used in the working structure of the invention are produced by Intel Corporation, 3065 Bowers Avenue, Santa Clara, Calif. 95051, and are model 2708 8K(1K×8) UV Erasable PROM devices, further described as "an 8192-bit ultraviolet light erasable and electrically reprogrammable EPROM" in undated specification sheets published by the manufacturer Prior to the date of the present patent application. Similar devices are also manufactured by other companies, and their structure and programming techniques are also well-known in the art. Two devices 134 and 136 are used because (as with the encoders 132 and 133) this size, in duplicate, constituted the most economical compromise for the use intended, even though only a portion of the second EPROM 136 (and the second encoder 133) is actually used. To completely specify the connections to be made in the EPROMs, so as to enable faithful replication by those skilled in the art, it is sufficient to refer to the three hundred and ninety-six addresses 117 and their corresponding register contents 112 (each a twelve-digit binary number) given in FIGS. 1–12.

Returning to FIG. 13, it will be seen that, because two EPROMs 134, 136 are used, it is necessary to connect each encoder output in parallel to the same input port of each EPROM 134, 136. Specifically, the encoder 132 has its Port P19 connected to the A9 port (address port 9) of both EPROMs; P18 to both A8 ports, P17 to both A7 ports, P16 to both A6, P15 to both A5, and P12 to both A4 ports of the EPROMs; while encoder 133 has its output port P19 connected to both A3 ports, P18 to both A2, P17 to both Al and P12 to both A0 Ports of the EPROMs. The EPROM programmed connections specified by the addresses 117 then produce the display driving instruction number at the twelve EPROM output ports as follows: EPROM 137 produces the first bit at port 07 (output port 7), the second bit at 06, the third bit at 0-.,5 the fourth bit at 04, the fifth bit at 03, the sixth bit at 02, the seventh bit at 01 and the eighth bit at 00 (0-zero). The remaining four bits are produced by EPROM 136 at its ports 07, 06, 05 and 04, respectively.

Each EPROM likewise has its own set of voltage supplies and ground connections (not shown); e.g., +5 volts, −5 volts and +12 volts, at ports specified by the manufacturer.

It now becomes Possible to infer the display-driving instruction number by scanning the EPROM outputs from top to bottom, as indicated in FIG. 13 under the reference arrow 112. It will be seen that this instruction number for the A-major chord is "100010010000", identical with that shown in FIG. 1 for the same chord.

The display indicators 101 selected for the operating structure of the invention are light-emitting diodes (LED's), and the driver chips 137 and 138 are operated by the EPROM output to cause the LED's 101 to be selectively energized by the voltage source 123*a*, as follows:

Each driver chip has six input ports 1A, 2A, 3A, 4A, 5A and 6A, and six output ports 1Y, 2Y, 3Y, 4Y, 5Y and 6Y, each connected to one of the note-energizing conductors 102, which in turn are energized by the voltage source 123*a* through the array of pull-up resistors 131. Thus the normal state of the LED's would be the energized state, unless inhibited by the operation of the driver chip. Each driver chip is an open collector buffer. Each input bit (at ports 1A–6A) is a corresponding one of the output bits from the PROMs (output ports 07 to 00 for EPROM 134 and ports 07 to 04 for EPROM 136). If the input to the driver is at logic 0 (ground), the output is at logic 0 (ground), and the current will flow from the voltage supply 123*a* through the pull-up resistors 131 to ground and the corresponding LED's 101 will not light up. If the input to the driver chip is at logic 1 (a positive voltage equal to or on the order of the voltage of source 123*a*), then the output of the chip will be a very high impedance (as if the connection between the chip and the LED's were broken); this condition allows the current to flow from the supply 123*a* through the pull-up resistors 131 and the selected LED's to ground, and the selected LED's are illuminated.

The driver chips illustrated in FIG. 13 are designated model 7407 Hex Buffer/Drivers with Open Collector, High Voltage Output manufactured by Texas Instrument Corporation, P.O. Box 225012 Dallas, Tex. 75265, and are described in the manufacturer's publication *The TTL Data Book Volume II,* 1985. As with the encoders and EPROMs, each driver chip has its own voltage source and ground connection (not shown), specified by the manufacturer.

In the present invention, for producing the chord in A major, for example, the drivers are programmed to function as follows; the logic 1 input to port IA of driver 137 causes the A-note conductor 102 to be energized and the A-note LED's to be illuminated. The logic 1 input to port 5A of driver 137 causes the C# conductor 102 to be energized and the corresponding LED's 101 to be illuminated, while the logic 1 input at port 00 of driver 137 causes the E-note LED's to be energized. All the other driver inputs are at logic 0, in this example, which is that of the A-major chord. In this way, all of the possible fingering positions for the A-major chord notes A, E and C# are indicated, and the student is made aware of his range of choice, and can then experimentally try different combinations until he has found those most suitable for the musical context and style of play that he is attempting to learn.

Figures 10, 11, 12, 14, 15:
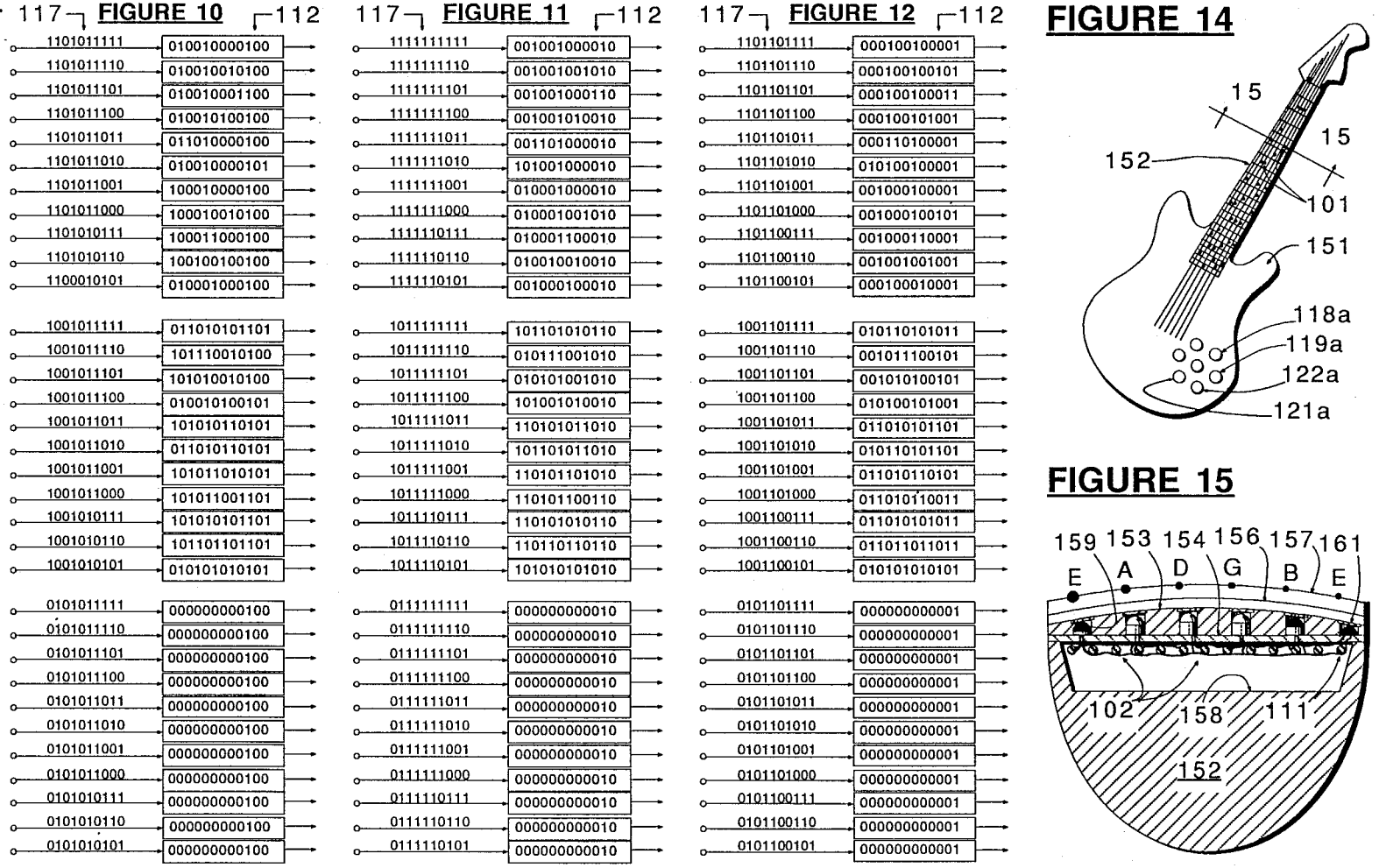
FIG. 10 is a schematic diagram continuing a portion of the arrangement shown in FIG. 11.
FIG. 12 is a schematic diagram continuing a portion of the arrangement shown in FIG. 1.
FIG. 14 is a plan view of a guitar including the structure of the invention.
FIG. 15 is an enlarged cross-sectional elevation view of the guitar neck, taken substantially on the plane of lines 15—15 of FIG. 14.

Details of construction for the neck and fingerboard of the guitar, incorporating the LED display of the invention, are shown in FIGS. 14 and 15.

A modern six-string electrical guitar 151 is shown, having twenty-three frets and a nut, to which the LEDs 101 of the invention have been applied, although only those are shown (as black circles) that are illuminated for producing the chord in A-major, as in FIGS. 1 and 13. Also shown are the rotary switches 118*a*, 119*a*, 121*a* and 122*a* mounted generally in the customary area adjacent three other switches (not numbered) of the type customarily used for controlling the electronic amplification of the sound that is received by a "pickup" (not shown) mounted on the body of the guitar beneath the strings.

Of course, it will be understood that the invention can be mounted on an "acoustical" or non-electric guitar, or even may he constructed separately from a guitar for simulation instruction or analysis. It will also be understood that the invention may be adapted for use with any sort of musical instrument that is manipulated by the fingers of the musician.

FIG. 15 is an enlarged cross-section of the neck 152 of the guitar shown in FIG. 14. On the upper part of the neck 152 is mounted the typical fingerboard 153; and an electrical circuitboard 154, forming part of the inventive structure, is sandwiched between the neck 152 and fingerboard 153. The three parts 152, 153 and 154 are glued or otherwise fastened together to form a rigid, unitary structure. Above the fingerboard 153 may be seen rising a fret 156, in this case the fourth fret, because the plane of the cross-section is taken outboard of the fifth fret. Still higher and farthest outboard rises the nut 157, upon which are stretched the strings E, A, D, G, B and E, which sit in conforming notches in the top edge of the nut 157.

In a recess 158 hollowed in the upper portion of the neck 152 (and shown in FIG. 15 in exaggerated depth for clarity of illustration), are disposed the conductors 102. To the leftmost conductor 102, which pertains to the LEDs for the A-note, is soldered a lead from the leftmost LED 159, making a connection identical to the connection 106 of Figures 1 and 13. This LED 159 and the two rightmost LEDs are shown in solid black, indicating energization to display the fifth-fret fingering positions for the A-major chord, namely a B-note position and two possible E-note positions (see also FIGS. 1 and 13). The other lead from LED 159 is soldered to the thirteenth or rightmost conductor 111 defining the ground connection.

Each of the LEDs is attached to the circuitboard 154 and is set in a conforming recess in the fingerboard covered by an inset transparent window pane 161.

It will be noted that each LED is offset substantially to the right of the string to which it pertains, so as to be aligned beneath the string in the musician's normal line of sight while playing the instrument. Such is the arrangement for a right-handed guitar. For a left-handed guitar, the offset would of course be to the left of the string.

What is claimed is:

1. Analyzing and teaching apparatus to be used in reference to a musical instrument of the type having at least one tone-selecting element manually operable in a range of configurations, comprising:

manually operable input means including an electrically powered circuit for entering the conventional musical designation of a predetermined set of tones;

said electrically powered circuit including a note-switch means having a first plurality of output lines, said note-switch means being manually operable to cause not more than two of said note-switch output lines to be selected at one time;

said circuit also including a mode-switch means having a second plurality of output lines, said mode-switch means being manually operable to cause one and only one of said mode-switch output lines to be selected at one time;

said circuit also including a type-switch means having a third plurality of output lines, said type-switch means being manually operable to cause one and only one of said type-switch output lines to be selected at one time; and indicating means coupled to said input means and responsive to the designation entered therein to give simultaneous indications of all the elements and all the configurations thereof corresponding to said predetermined set of tones.

2. The apparatus recited in claim 1, wherein:

said instrument is a guitar and said tone-selecting elements include the guitar strings and the guitar fingerboard against which the strings are pressed by the fingers of the musician to alter the configurations of the strings and particularly the freely vibrating lengths of the strings, thus to produce musical tones of various frequencies, there being more than one fingering position and more than one corresponding configuration for each string for each tone, including the not-fingered "open-string" configuration thereof; and said input means includes an electrically-powered circuit including switches that are manually operable to designate various tone-sets including one-member note sets, and multimembered sets of chords and of scales.

3. The apparatus recited in claim 2, wherein said switches include note switch means for causing said circuit to designate any of the twelve conventional musical notes A, A-sharp (B-flat), B, C, C-sharp (D-flat), D, D-sharp (E-flat), E, F, F-sharp (G-flat), G and G-sharp (A-flat).

4. The apparatus recited in claim 3, wherein said note switch means is a single switch having twelve positions corresponding to said twelve conventional notes.

5. The apparatus recited in claim 3, wherein said note switch means is comprised by a natural-notes switch having seven positions corresponding to the natural notes A, B, C, D, E, F and G, and an accidentals switch having three positions corresponding to the flat, sharp and natural variations of the natural notes;

said natural-notes and accidentals switches being connected in said circuit to cause said circuit to designate only the twelve conventional notes.

6. The apparatus recited in claim 5, wherein said switches also include a mode switch having twelve sets each of three parallel-coupled input terminals and the accidentals switch has twenty-one notes-designating output lines dedicated to the seven natural notes, the seven sharps and the seven flats, each of said accidentals output lines being coupled to an input terminal set of the mode switch;

the A-output, the D-output and the 0-output lines of the accidentals switch being coupled to first, second and third sets, respectively, of input terminals of the mode switch;

the A-sharp and B-flat output lines of the accidentals switch being coupled in parallel to a fourth set of three input terminals of the mode switch;

the B and C-flat output lines of the accidentals switch being coupled in parallel to a fifth set of three input terminals of the mode switch;

the B-sharp and C output lines of the accidentals switch being coupled in parallel to a sixth set of three input terminals of the mode switch;

the C-sharp and D-flat output lines of the accidentals switch being coupled in parallel to a seventh set of three input terminals of the mode switch;

the D-sharp and E-flat output lines of the accidentals switch being coupled in parallel to an eighth set of three input terminals of the mode switch;

the E and F-flat output lines of the accidentals switch being coupled in parallel to a ninth set of three input terminals of the mode switch;

the E-sharp and F output lines of the accidentals switch being coupled in parallel to a tenth set of three input terminals of the mode switch;

the F-sharp and G-flat output lines of the accidentals switch being coupled in parallel to an eleventh set of three input terminals of the mode switch; and the G-sharp and A-flat output lines of the accidentals switch being coupled in parallel to a twelfth set of three input terminals of the accidentals switch.

7. The apparatus recited in claim 6, wherein said switches also include a type switch having twelve sets each of three mode input terminals with each mode input terminal having a corresponding set of type output lines, and the mode switch has twelve sets each of three mode output lines, a first mode output line in each set being coupled to a first of the mode input terminals to a different set of the type switch.

a second mode output line of each of said mode sets being coupled to a second input terminal of a different set of the type switch; and a third mode output line of each of said mode sets being coupled to a third input terminal of a different set of the type switch.

8. The apparatus recited in claim 7, wherein the first input terminal of each set of the type switch has a corresponding set of output lines each dedicated to a different combination of concurrently-played notes constituting a chord;

the second input terminal of each set of the type switch has a corresponding set of output lines each dedicated to a different combination of notes constituting a scale; and each third input terminal of the type switch has a corresponding set of output lines dedicated to a different one of the twelve notes.

9. The apparatus recited in claim 8, wherein each set of chord output lines comprises eleven dedicated to the following conventional chords: major, seventh, major seventh, major sixth, suspended fourth, ninth, minor, minor seventh, minor sixth, diminished and augmented.

10. The apparatus recited in claim 8, wherein each set of the scale output lines comprises eleven dedicated to the following conventional scales: major, blues, pentatonic blues, country, dorian mode, mixolydian mode, natural minor, harmonic minor, melodic minor, diminished, and whole-tone.

11. The apparatus recited in claim 8, wherein each set of the note output lines comprises at least one dedicated to a different one of the twelve notes.

12. The apparatus recited in claim 1, said note-switch means being manually operable to cause one and only one of said note-switch output lines to be energized at one time;

said mode-switch means being operable in tandem ganged fashion to cause one and only one of said mode-switch output lines to be energized at one time; and said type-switch means being operable in tandem ganged fashion to cause one and only one of said type-switch output lines to be energized at one time.

13. The apparatus recited in claim 12 and also including a display-selecting memory register coupled to each of said type-switch output lines, each of said registers having a set of display-selecting output lines equal in number to said first plurality of notes;

each of said registers having predetermined internal connections for causing only a certain subset of display-selecting output lines to be energized at one time;

said apparatus also including a display array comprising a multi-member set of indicators for each of said notes, the indicators in each of said multi-member sets being dedicated to one and only one of said notes and being coupled in parallel for concurrent energization so as to display all of the tone-selecting elements and configurations thereof that are possible for the production of said one and only one note; and each of the display-selecting output lines of each register being coupled to a different one of said multi-membered sets of indicators for the selective energization thereof in accordance with said internal connections of said register.

14. The apparatus recited in claim 1, and also including encoder means coupled to said output lines of said note-switch means, said mode-switch means and said type switch means;

said encoder means being pre-programmed to produce an address signal designating the note, the mode and the type for which said switch output lines are selected.

15. The apparatus recited in claim 14 and also including a display array comprising a multi-member set of indicators for each of said notes, the indicators in each of said multi-member sets being dedicated to one and only one of said notes and being coupled in parallel for concurrent energization so as to display all of the tone-selecting elements and configurations thereof that are possible for the production of said one and only one note;

said apparatus also including a programmable-read-only-memory chip containing a display-selecting memory register for each of said addresses, each of said registers having predetermined internal connections for producing an output signal from said memory chip designating the notes corresponding to the combination of note, mode and type designated by the address;

said chip being coupled to receive said address signal from said encoder means and to thereupon select the register designated by said address;

said apparatus also including driver means coupled to said memory chip to receive said chip output signal, said driver means having a set of display-selecting output lines equal in number to said first plurality of notes, and being pre-programmed to cause only a certain subset of display-selecting output lines to be energized at one time, said certain subset corresponding to the internal connections of said register; and each of the display-driving output lines of said driver means being coupled to a different one of said multi-membered sets of note indicators for the selective energization thereof in accordance with said internal connections of said register.

16. The apparatus recited in claim 15, wherein:

said note-switch means includes a natural-notes switch having seven output lines each dedicated to a different one of the following natural notes: A, B, C, D, E, F, G:

said note-switch means also includes an accidentals switch having three output lines each dedicated to a different one of the following accidental variations: flat, sharp, natural;

said mode-switch having three output lines each dedicated to a different one of the following mode-sets: chords, scales, single notes; and said type-switch having eleven output lines each dedicated to a different one of the following labels for note-sets: SC0, SC1, SC2, SC3, SC4, SC5, SC6, SC7, SC8, SC9, SC10.

17. The apparatus recited in claim 16 wherein said note, mode and type switches are connected in said circuit to provide zero-voltage output signals, in said selected output lines, representing the logical bit "0" (zero), also termed the "not" ("/") signal, and other-than-zero-voltage output signals in all of the unselected switch output lines, representing the logical bit "1"; and said encoder means having ten output lines and being pre-programmed to respond to said switch output signals by producing said encoder output address signal in the form of an ordered array of ten logical bits, one for each encoder output line, in accordance with the following logic equations in which the terms on the right of the equality ("=") sign define the various combinations of switch-output-line signals that produce from the encoder the "not" (logical zero) signal named on the left of the equality sign, the non-existence of the combinations listed on the right in each equation being the condition for production of a logical "1" for the encoder output signal named on the left:

/R3=/A+/B+/C*/b+/C*-/nat+/F*/♯+/G*/b+/G*/♯ (1)

/R2=/D+/A*/♯+/E*/b+/B*/b+/B*/♯+/C*-/nat+/C*/♯ (2)

/R1=/E+/F+/G*/b+/A*/nat+/D*-/nat+/D*/♯ (3)

/R0=/A+/B*/b+/D*/♯+/E*/b+/E*/-nat+/F*/b+/G*/♯ (4)

/M1=/scale*chord (5)

/M0=chord*scale (6)

/T3=/SC8+/SC9+/SC10 7)

/T2=/SC7+/SC6+/SC5+/SC4 (8)

/T1=/SC10+/SC7+/SC6+/SC3+/SC2 (9)

/T0=/SC9+/SC7+/SC5+/SC3+/SC1 (10)

the terms "nat" meaning "natural", "♯" meaning "sharp", "b" meaning "flat", the symbol "+" meaning the logical "or", and the symbol "*" meaning the logical "and".

18. The apparatus recited in claim 1, in which the musical instrument is a guitar having a fingerboard long enough for the production of at least one octave of audible tones, said indication means comprising an electrical power source and an array of electrically energizable lamps, one of said lamps being mounted on said fingerboard beneath the guitar strings substantially at each position where each string may be fingered for the production of a conventional musical note, including the not-fingered "open string" position for which said lamps are mounted outboard of the guitar nut, said manually operable input means comprising electrical switches mounted with the manual control portions thereof on the body of the guitar.

19. The apparatus recited in claim 18, wherein said guitar is fretted, and said lamps are mounted in conforming recesses in said fingerboard so as to be recessed below the surface envelope of said fingerboard, with a row of lamps in the space outboard from each fret and the nut, one lamp in each row being dedicated to a different string of said guitar, and each lamp being offset substantially laterally from the string to which the lamp is dedicated, the direction of offset being the same as the handedness of the guitar, whereby the lamps are more closely aligned with the strings to which they are dedicated in the normal line of sight of the musician holding the guitar in the conventional position for playing.

* * * * *